US007966856B1

(12) United States Patent
Razi et al.

(10) Patent No.: US 7,966,856 B1
(45) Date of Patent: Jun. 28, 2011

(54) ROBOTIC PEENING APPARATUS

(75) Inventors: Salahuddin Razi, Naperville, IL (US); Brian D. Albin, Chicago, IL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/638,575

(22) Filed: Dec. 15, 2009

(51) Int. Cl.
*B21D 7/06* (2006.01)
*B24C 7/00* (2006.01)

(52) U.S. Cl. ..... 72/53; 29/90.7; 451/38; 451/39

(58) Field of Classification Search ..... 72/53; 29/90.7; 451/38, 39
See application file for complete search history.

(56) References Cited

U.S. PATENT DOCUMENTS 4,437,213 A 3/1984 Reese et al.
4,713,952 A * 12/1987 Senger et al. ..... 72/53
4,762,261 A 8/1988 Hawly et al.
5,048,316 A * 9/1991 Thompson ..... 72/53
5,060,375 A 10/1991 Demichel
5,166,885 A * 11/1992 Thompson ..... 72/53
5,797,290 A * 8/1998 Blissell et al. ..... 72/53
6,189,355 B1 * 2/2001 Ichihashi et al. ..... 72/53
6,516,645 B2 * 2/2003 Morales et al. ..... 72/53
6,606,892 B2 8/2003 Fischer et al.
6,683,976 B2 * 1/2004 Dulaney et al. ..... 382/151
6,867,390 B2 * 3/2005 Clauer et al. ..... 219/121.85
7,389,662 B2 6/2008 Roberts et al.
7,421,872 B2 * 9/2008 Indlekofer ..... 72/53

* cited by examiner

*Primary Examiner* — David B Jones
(74) *Attorney, Agent, or Firm* — Hoffman Warnick LLC; Ernest G. Cusick

(57) ABSTRACT

Solutions for robotic fastener peening in turbine machines are disclosed. In one embodiment, an apparatus includes: a peening machine having a peening head; a robotic apparatus including: a robotic arm coupled to the peening machine; and a base member coupled to the robotic arm, the base member mounted independently of the machine element; a vision system for locating a fastener on the machine element; and a control system coupled to the vision system, the peening machine and the robotic apparatus, the control system configured to control movement of the robotic apparatus and the peening machine based upon vision system data and spatial information about the fastener and the machine element.

20 Claims, 5 Drawing Sheets

ROBOTIC PEENING APPARATUS

BACKGROUND OF THE INVENTION

The subject matter disclosed herein relates to a robotic peening apparatus. Specifically, the subject matter disclosed herein relates to a robotic peening apparatus for peening fasteners in a turbine machine.

In the construction of turbines (e.g., steam turbines), cover plates are employed for a variety of reasons and are generally secured to the tips of turbine buckets by peening fasteners formed on the buckets or cover plates. To secure the bucket tips and cover plates to one another, solid fasteners on the admission sides of the cover plates are peened into the bucket tip openings. Conventionally, the fasteners are peened into the bucket chamfers using a reciprocating riveting tool. This riveting tool may be hand-held by an operator, or may be mounted on a portion of the turbine.

BRIEF DESCRIPTION OF THE INVENTION

Solutions for robotic fastener peening in turbine machines are disclosed. In one embodiment, an apparatus includes: a peening machine having a peening head; a robotic apparatus including: a robotic arm coupled to the peening machine; and a base member coupled to the robotic arm, the base member mounted independently of the machine element; a vision system for locating a fastener on the machine element; and a control system coupled to the vision system, the peening machine and the robotic apparatus, the control system configured to control movement of the robotic apparatus and the peening machine based upon vision system data and spatial information about the fastener and the machine element.

A first aspect of the invention provides an apparatus for peening a fastener on a machine element, the apparatus comprising: a peening machine having a peening head; a robotic apparatus including: a robotic arm coupled to the peening machine; and a base member coupled to the robotic arm, the base member mounted independently of the machine element; a vision system for locating the fastener on the machine element; and a control system coupled to the vision system, the peening machine and the robotic apparatus, the control system configured to control movement of the robotic apparatus and the peening machine based upon vision system data and spatial information about the fastener and the machine element.

A second aspect of the invention provides a machining station comprising: a surface; a portion of a turbine rotor in contact with the surface, the portion of the turbine rotor including a machine element having at least one fastener thereon; and an apparatus for peening the at least one fastener, the apparatus comprising: a peening machine having a peening head; a robotic apparatus including: a robotic arm coupled to the peening machine; and a base member coupled to the robotic arm, the base member in contact with the surface independently of the portion of the turbine rotor; a vision system for locating the at least one fastener on the machine element; and a control system coupled to the vision system, the peening machine and the robotic apparatus, the control system configured to control movement of the robotic apparatus and the peening machine based upon vision system data and spatial information about the at least one fastener and the machine element.

A third aspect of the invention provides a machining station comprising: a supportive surface; a stand in contact with the supportive surface; a portion of a turbine rotor in contact with the stand, the portion of the turbine rotor including a machine element having at least one fastener thereon; and an apparatus for peening the at least one fastener, the apparatus comprising: a peening machine having a peening head; a robotic apparatus including: a robotic arm coupled to the pneumatic peening machine; and a base member coupled to the robotic arm, the base member in contact with the supportive surface independently of the stand; a vision system for locating the at least one fastener on the machine element; and a control system coupled to the vision system, the peening machine and the robotic apparatus, the control system configured to control movement of the robotic apparatus and the peening machine based upon vision system data and spatial information about the at least one fastener and the machine element.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide for peening of fasteners using a robotic apparatus. The robotic apparatus may be configured to peen fasteners on a machine element (e.g., a portion of a turbine machine) while being mounted independent of the machine element. In one embodiment, the robotic apparatus may be configured to peen fasteners on a machine element while contacting only the fastener being peened. As used herein, the term "fastener" may include any device capable of joining two members (e.g., machine elements) together through peening as described herein. For example, a fastener may include a tenon, a rivet, a swell, etc.

Figure 1:
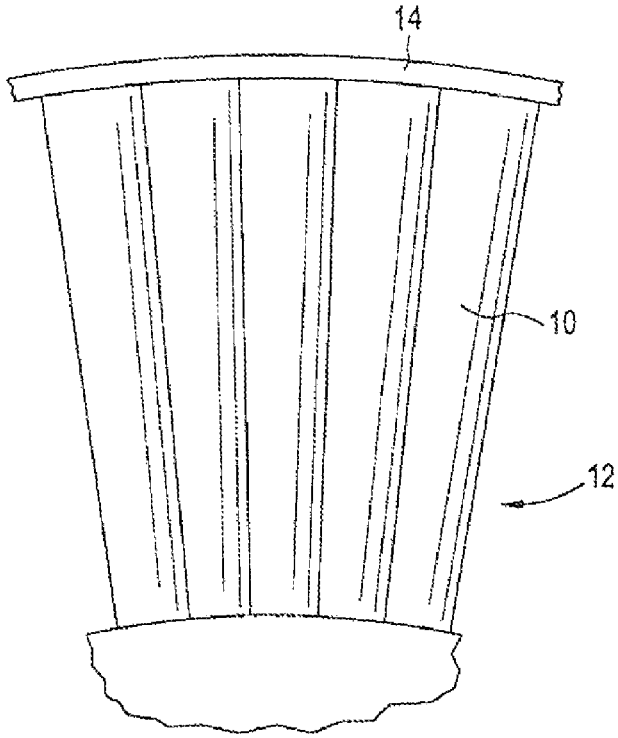
FIGS. 1-3 show fragmentary views of portions of a turbine during the fastener peening process.
Figure 2:
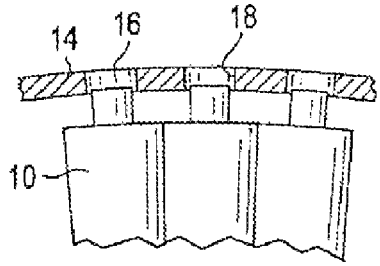
Figure 3:
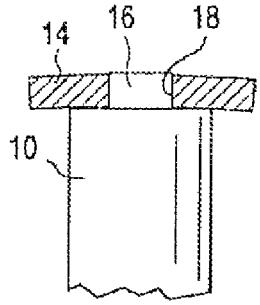

Turning to the drawings, FIGS. 1-3 illustrate portions of the peening process as performed on a section of a turbine machine. FIG. 1 shows a plurality of buckets 10 forming part of a rotating component of a turbine (e.g., steam turbine) 12. A cover plate 14 is shown secured to the outer tips of buckets 10, where cover plate 14 extends in a circumferential direction about buckets 10. FIGS. 2-3 show the tips of buckets 10 having one or more fasteners 16 projecting radially outward therefrom. Each cover plate 14 may include an arcuate circumferentially extending segment for spanning a plurality of buckets 10 (e.g., four or five buckets). Each cover plate 14 may include a plurality of openings 18 for receiving fasteners 16. Fasteners 16 may be received in openings 18 and peened to form a substantially flush cover design, as shown in FIG. 3.

Fasteners in a turbine machine (e.g., steam turbine) are often peened into turbine bucket chamfers using a reciprocating riveting tool. In some cases this riveting tool may be hand-held by an operator, and in other cases it may be mounted on a portion of the turbine. The hand-held approach may have significant drawbacks. For example, an operator of a hand-held riveting tool may suffer physical injuries as vibrations from the riveting tool are transferred to the operator's arms, upper torso, etc. Further, when peening multiple fasteners, a human operator may become fatigued. This operator fatigue increases processing time and adversely affects the consistency of peening across multiple fasteners.

The turbine-mounted approach may also have significant drawbacks. For example, when peening multiple fasteners on one or more portions of a turbine, moving a turbine-mounted riveting tool can be cumbersome and time-consuming. Further, turbine-mounted riveting tools may require operator-aided alignment of riveting heads to ensure accurate and complete peening of fasteners.

Figure 4:
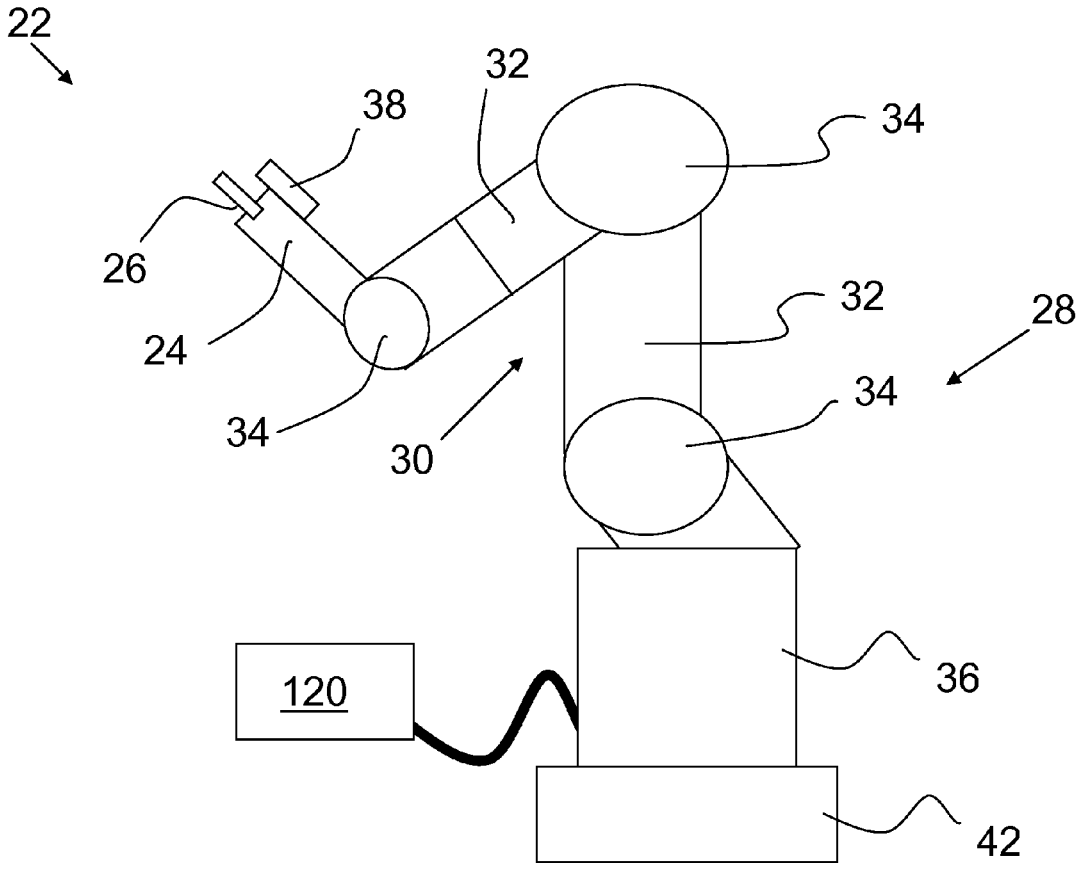
FIG. 4 shows a side schematic view of an apparatus for peening a fastener according to an embodiment of the invention.

Turning to FIG. 4, an apparatus 22 for peening a fastener according to an embodiment of the invention is shown. Apparatus 22 may include a peening machine 24 having a peening head 26. Peening machine 24 may include any conventional peening machine capable of peening a fastener into a member (e.g., machine element). In one embodiment, peening machine 24 may be a pneumatic peening hammer capable of striking a fastener (e.g., a tenon) with peening head 26 at a pressure of approximately 30 pounds per square inch (psi) to approximately 80 psi. Peening machine 24 may include a drive member (not shown), as well as a striking member (e.g., peening head 26). Peening head 26 may be formed of a metal (e.g., steel), which may be configured to peen a plurality of fasteners (e.g., metal tenons) over its useful lifetime.

Also shown in FIG. 4 is an embodiment of a robotic apparatus 28, which may include a robotic arm 30 coupled to peening machine 24. Robotic apparatus 28 and peening machine 24 may be coupled in any conventional manner, e.g., via joints, welds, clamps, etc. In this embodiment, robotic arm 30 may include a plurality of segments 32 and joints 34 allowing robotic arm 30 to assist in peening fasteners at different locations on a machine element (not shown). Robotic apparatus 28 is also shown including a base member 36 coupled to robotic arm 30. Base member 36 may be coupled to robotic arm 30 in any conventional manner, e.g., via joints, welds, slots, clamps, etc. Base member 36 and robotic arm 30 may each be formed of distinct materials, or may be formed of substantially similar materials. In one embodiment, base member 36 includes a metal such a structural steel. Robotic arm 30 may include a metal such as structural steel, cast iron, and/or stainless steel. It is understood that robotic apparatus 28 (including robotic arm 30 and base member 36) may include electrical and electro-mechanical components capable of actuating movement of robotic arm 30 and/or peening machine 24. These electrical and electro-mechanical components are known in the art of robotics, and are not described specifically herein for clarity.

Also shown in FIG. 4 is a vision system 38 for locating a fastener or other reference point on a machine element, e.g., a turbine cover plate (FIG. 3). Vision system 38 may include a conventional two-dimensional or three-dimensional optical recognition system which may detect a location of a fastener on the machine element. Vision system 38 may be capable of high speed image acquisition and processing, and may locate a shape of a fastener 16 by optically recognizing the original fastener design (e.g., the original shape of a tenon as indicated by spatial information 140, described with reference to FIG. 5).

Apparatus 22 may also include a computer system 120 coupled to vision system 38, peening machine 24, and robotic apparatus 38. Computer system 120 may be configured to control movement of robotic apparatus 28 and peening machine 24 via a robotic control system 40 (FIG. 5), based upon data received from vision system 38 and spatial information about the fastener and the machine element. Robotic control system 40 and spatial information will be described in further detail with respect to subsequent figures (e.g., FIG. 5). Also shown in FIG. 4 is a shock absorbing member 42 coupled to base member 36. Shock absorbing member 42 may include one or more types of material capable of absorbing forces caused by vibrations within robotic apparatus 28. For example, shock absorbing member 42 may include a plurality of (e.g., three) distinct rubber vibration dampening pads, which may isolate the vibration of robotic apparatus 28 from a surface (e.g., supportive surface 52 of FIGS. 6-7). In any case, shock absorbing member 42 may be configured to reduce vibration in robotic apparatus 38 and peening machine 24, and improve the performance of apparatus 22.

Figure 5:
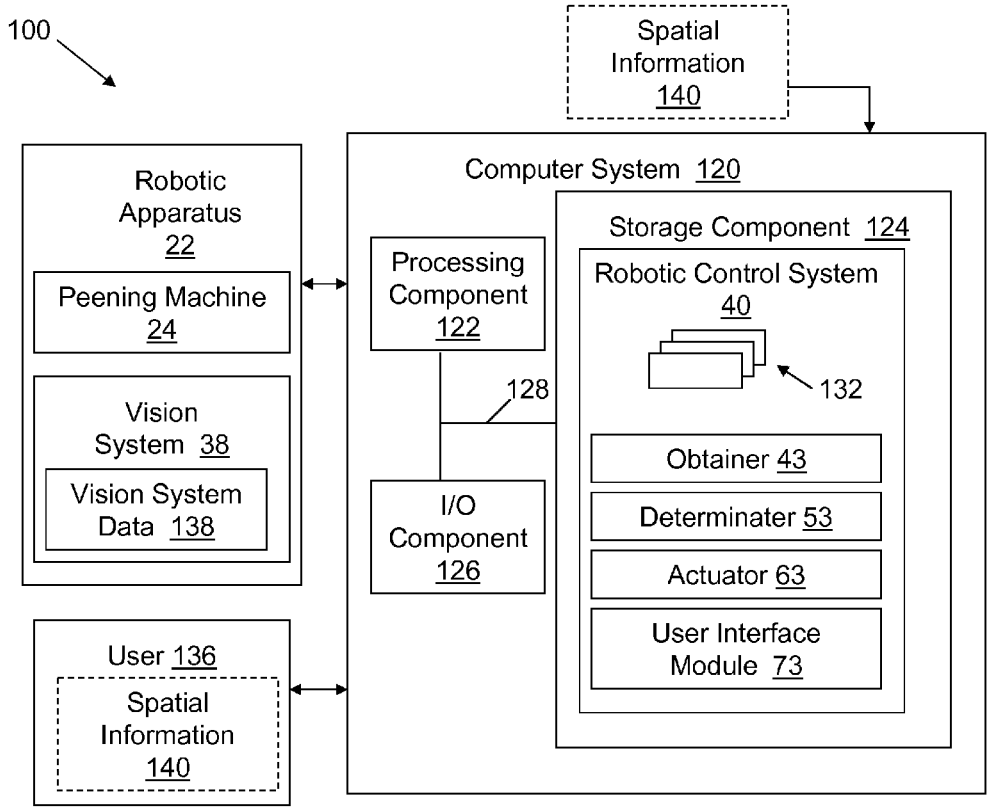
FIG. 5 shows an illustrative environment of an apparatus for peening a fastener according to an embodiment of the invention.

Turning to FIG. 5, an illustrative environment 100 for robotic fastener peening is disclosed. To this extent, environment 100 includes computer system 120, which can perform processes described herein in order to peen fasteners using apparatus 22. In particular, computer system 120 is shown including a robotic control system 40, which makes computer system 120 operable to provide instructions to apparatus 22 for peening fasteners by performing a process described herein.

Computer system 120 is shown in communication with apparatus 22, which may include peening machine 24 and vision system 38. Further, computer system 120 is shown in communication with a user 136. A user 136 may be, for example, a programmer or operator. Interactions between these components and computer system 120 will be discussed in subsequent portions of this application. Computer system 120 is shown including a processing component 122 (e.g., one or more processors), a storage component 124 (e.g., a storage hierarchy), an input/output (I/O) component 126 (e.g., one or more I/O interfaces and/or devices), and a communications pathway 128. In one embodiment, processing component 122 executes program code, such as robotic control system 40, which is at least partially embodied in storage component 124. While executing program code, processing component 122 can process data, which can result in reading and/or writing the data to/from storage component 124 and/or I/O component 126 for further processing. Pathway 128 provides a communications link between each of the components in computer system 120. I/O component 126 can comprise one or more human I/O devices or storage devices, which enable user 136 to interact with computer system 120 and/or one or more communications devices to enable user 136 to communicate with computer system 120 using any type of communications link. To this extent, robotic control system 40 can manage a set of interfaces (e.g., graphical user interface(s), application program interface, and/or the like) that enable human and/or system interaction with robotic control system 40.

In any event, computer system 120 can comprise one or more general purpose computing articles of manufacture (e.g., computing devices) capable of executing program code installed thereon. As used herein, it is understood that "program code" means any collection of instructions, in any language, code or notation, that cause a computing device having an information processing capability to perform a particular function either directly or after any combination of the following: (a) conversion to another language, code or notation;

(b) reproduction in a different material form; and/or (c) decompression. To this extent, robotic control system 40 can be embodied as any combination of system software and/or application software. In any event, the technical effect of computer system 120 is to provide processing instructions to apparatus 22 in order to peen fasteners.

Further, robotic control system 40 can be implemented using a set of modules 132. In this case, a module 132 can enable computer system 20 to perform a set of tasks used by robotic control system 40, and can be separately developed and/or implemented apart from other portions of robotic control system 40. Robotic control system 40 may include modules 132 which comprise a specific use machine/hardware and/or software. Regardless, it is understood that two or more modules, and/or systems may share some/all of their respective hardware and/or software. Further, it is understood that some of the functionality discussed herein may not be implemented or additional functionality may be included as part of computer system 120.

When computer system 120 comprises multiple computing devices, each computing device may have only a portion of robotic control system 40 embodied thereon (e.g., one or more modules 132). However, it is understood that computer system 120 and robotic control system 40 are only representative of various possible equivalent computer systems that may perform a process described herein. To this extent, in other embodiments, the functionality provided by computer system 120 and robotic control system 40 can be at least partially implemented by one or more computing devices that include any combination of general and/or specific purpose hardware with or without program code. In each embodiment, the hardware and program code, if included, can be created using standard engineering and programming techniques, respectively.

Regardless, when computer system 120 includes multiple computing devices, the computing devices can communicate over any type of communications link. Further, while performing a process described herein, computer system 120 can communicate with one or more other computer systems using any type of communications link. In either case, the communications link can comprise any combination of various types of wired and/or wireless links; comprise any combination of one or more types of networks; and/or utilize any combination of various types of transmission techniques and protocols.

As discussed herein, robotic control system 40 enables computer system 120 to provide processing instructions to apparatus 22 for peening fasteners. Robotic control system 40 may include logic, which may include the following functions: an obtainer 43, a determinator 53, an actuator 63 and a user interface module 73. In one embodiment, robotic control system 40 may include logic to perform the above-stated functions. Structurally, the logic may take any of a variety of forms such as a field programmable gate array (FPGA), a microprocessor, a digital signal processor, an application specific integrated circuit (ASIC) or any other specific use machine structure capable of carrying out the functions described herein. Logic may take any of a variety of forms, such as software and/or hardware. However, for illustrative purposes, robotic control system 40 and logic included therein will be described herein as a specific use machine. As will be understood from the description, while logic is illustrated as including each of the above-stated functions, not all of the functions are necessary according to the teachings of the invention as recited in the appended claims.

Figure 6:
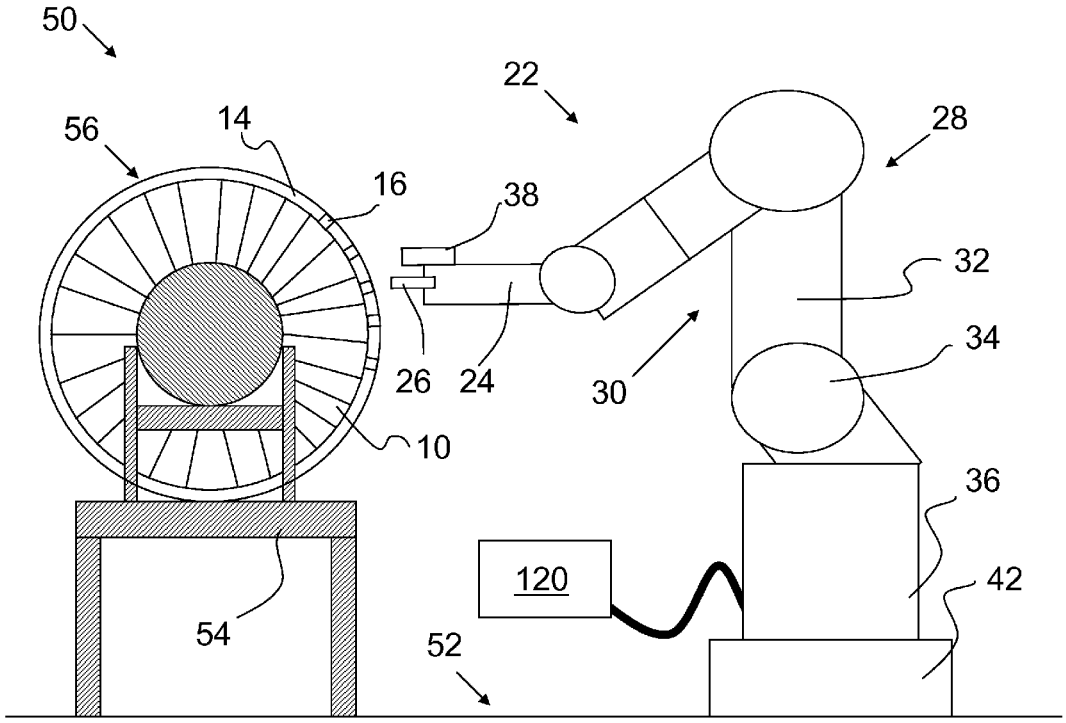
FIG. 6 shows a side schematic view of a machining station according to an embodiment of the invention.

Turning to FIG. 6, an illustrative embodiment of a machining station 50 is shown according to one embodiment of the invention. Shown in this embodiment are a supportive surface 52, a stand 54 in contact with supportive surface 52, a portion of a turbine rotor 56 in contact with stand 54, apparatus 22, and computer system 120. Supportive surface 52 may be any surface capable of structurally supporting the weight of stand 54, portion of turbine rotor 56 and/or apparatus 22 and computer system 120. In one embodiment, supportive surface 52 may include concrete, and may collectively support the components shown in FIG. 6. In one embodiment, supportive surface 52 may be a floor in a machining station 50, such as a manufacturing floor. Stand 54 may be any stand capable of structurally supporting the weight of portion of turbine rotor 56 (e.g., at one or more contact points). Stand 54 may include a metal (e.g., steel, iron, etc.) or may be formed of a high-strength plastic or other material. Stand 54 may hold the portion of turbine 56 substantially firmly so as to allow apparatus 22 to peen fasteners on portion of turbine 56 without substantially displacing portion of turbine 56 or stand 54.

Portion of turbine rotor 56 may include one or more machine elements such as a turbine bucket 10, at least one cover plate 14, and at least one fastener 16 thereon (several shown for illustrative purposes). Description of turbine bucket 10, cover plate 14 and fastener 16 are included with reference to FIGS. 1-3. Other elements of portion of turbine rotor 56 are omitted for clarity, however, it is understood that portion of turbine rotor 56 may include any conventional turbine components not specifically described herein.

During operation, apparatus 22 may peen one or more fasteners 16 using vision system 38, robotic arm 28 and peening machine 24. In one embodiment, apparatus 22 may use vision system 38 to locate the fastener 16, robotic arm 28 to align peening machine 24 with the fastener 16, and peening head 26 (actuated by peening machine 24) to peen (hammer) fastener 16. In one embodiment, peening machine 24 may be a pneumatic peening machine including peening head 26. In this case, the pneumatic peening machine may allow for apparatus 22 to peen fastener 16 while only contacting fastener 16. That is, in one embodiment, apparatus 22 may peen fastener 16 while its base member 42 is in contact with supportive surface 52 independent of stand 54 (and portion of rotor 56). This may allow apparatus 22 to peen fastener 16 without having to affix itself to stand 54 and/or portion of rotor 56. This freedom of movement may reduce the time required to peen multiple fasteners 16. As shown and described herein, machining station 50 may further include computer system 120, coupled to one or more of vision system 38, peening machine 24 and apparatus 22. In one embodiment, robotic control system 40 is coupled to each of these components (via, e.g., computer system 120), and is configured to control movement of the apparatus 22 (including peening machine 24) based upon vision system data and spatial information about fastener 16 and machine element (e.g., cover plate 14 and/or bucket 10).

Turning back to FIG. 5, and with continuing reference to FIG. 6, aspects of robotic control system 40 will be further described according to one embodiment. In this embodiment, robotic control system 40 may include an obtainer 43 for obtaining spatial information 140 from one of a user 136 (shown in phantom) or an external source (e.g., an external database, not shown). Spatial information 140 may include information about the locations of one or more fasteners 16 on one or more cover plates 14. Spatial information 140 may, for example, include three-dimensional (3-D) coordinates indicating a location of a center point, corner, or other point on a fastener 16. Spatial information 140 may further indicate a size and shape of a fastener 16, as well as its radial and axial position around the portion of rotor 56. Spatial information 140 may further indicate a distance between a plurality of fasteners 16 along one or more cover plates 14. For example, where a plurality of fasteners 16 are non-uniformly spaced along one or more cover plates 14, spatial information 140 may indicate the spacing between each of the plurality of fasteners 16. It is understood that spatial information 140 may include any information indicating spatial relationships (e.g., 3-D coordinates) between one or more points on portion of turbine 56, stand 54, supportive surface 52 and/or other objects in machining station 50 not specifically described. As indicated above with respect to FIG. 5, in one embodiment, obtainer 43 may obtain spatial information 140 from a user 136. In this case, user 136 may be an operator or user of computer system 120 and apparatus 22. User 136 may provide spatial information to obtainer 43 through, e.g., user interface module 73. User interface module 73 may, for example, include a graphical user interface (GUI) or any other user interface known in the art. In another embodiment, obtainer 43 may obtain spatial information 140 from a database or other source. For example, obtainer 43 may obtain spatial information 140 from design figures depicting portion of turbine 56, stand 54, supportive surface 52, apparatus 22, and/or any other elements included in machining station. It is understood that design figures may be digital figures which may be converted into spatial information 140, or that design figures may be physical drawings which may be scanned and optically analyzed to provide spatial information 140. In any case, after obtaining spatial information 140, robotic control system 40 may use spatial information 140 to manipulate apparatus 22 (as further described herein).

Obtainer 43 may further obtain vision system data 138 from vision system 38. In one embodiment, vision system data 138 may indicate a location of a reference point on apparatus 22 with respect to a point on portion of turbine 56, stand 54, supportive surface 52, etc. In this case, vision system data 138 about the location of apparatus 22 (and specifically, peening machine 24 and peening head 26) may be obtained using any conventional optical means. For example, vision system 138 may locate the position of a fastener relative to any conventional coordinate system, e.g., global and/or tool frame coordinate systems. In any case, obtainer 43 may obtain vision system data 138 from vision system 38, and may convert vision system data 138 into any format necessary to allow determinator 53 to compare vision system data 138 with spatial information 140 to determine a desired movement of apparatus 22.

As indicated above, after obtaining vision system data 138 and spatial information 140, determinator 53 may compare the data to determine a desired movement of apparatus 22. For example, where determinator 53 determines that peening head 26 is aligned with a desired peening location on a fastener 16 in two of three dimensions, determinator 53 may determine that peening machine 24 should be moved in only the third dimension to align with the desired peening location. In another example, determinator 53 may determine that peening head 26 is aligned in a desired peening location in all three dimensions and that fastener 16 was not previously peened (e.g., based upon vision system data 138 and/or spatial information 140 indicating that peening head 26 has not been at this location previously). In this case, determinator 53 may determine that peening of fastener 16 is necessary. Where determinator 53 determines that peening of fastener 16 is necessary, actuator 63 may provide instructions to peening machine 24 to actuate peening head 26.

Actuator 63 may, for example, provide instructions to peening machine 24 to actuate peening head 26 according to a pre-determined pattern. This pre-determined pattern may be based upon whether the fastener 16 has been previously peened. For example, a new (never peened) fastener 16 may require more peening (e.g., more strikes per point) than a fastener that has already been peened. In this case, actuator 53 may provide instructions for peening a "new" fastener. In another embodiment, fastener 16 may have been previously peened (e.g., portion of turbine 56 is being refurbished). In this case, actuator 53 may provide instructions to peening machine 24 for a "refurbished" fastener. In any case, actuator 53 may provide instructions to peening machine 24 for peening one or more fasteners 16 on portion of turbine 56. It is further understood that actuator 63 may provide instructions to apparatus 22 (e.g., robotic arm 28) for moving peening machine 24 (and specifically, peening head 26) into a desired position for peening. That is, actuator 53 may provide instructions for moving one or more elements of apparatus 22 to a desired position to facilitate peening of one or more fasteners 16.

Figure 7:
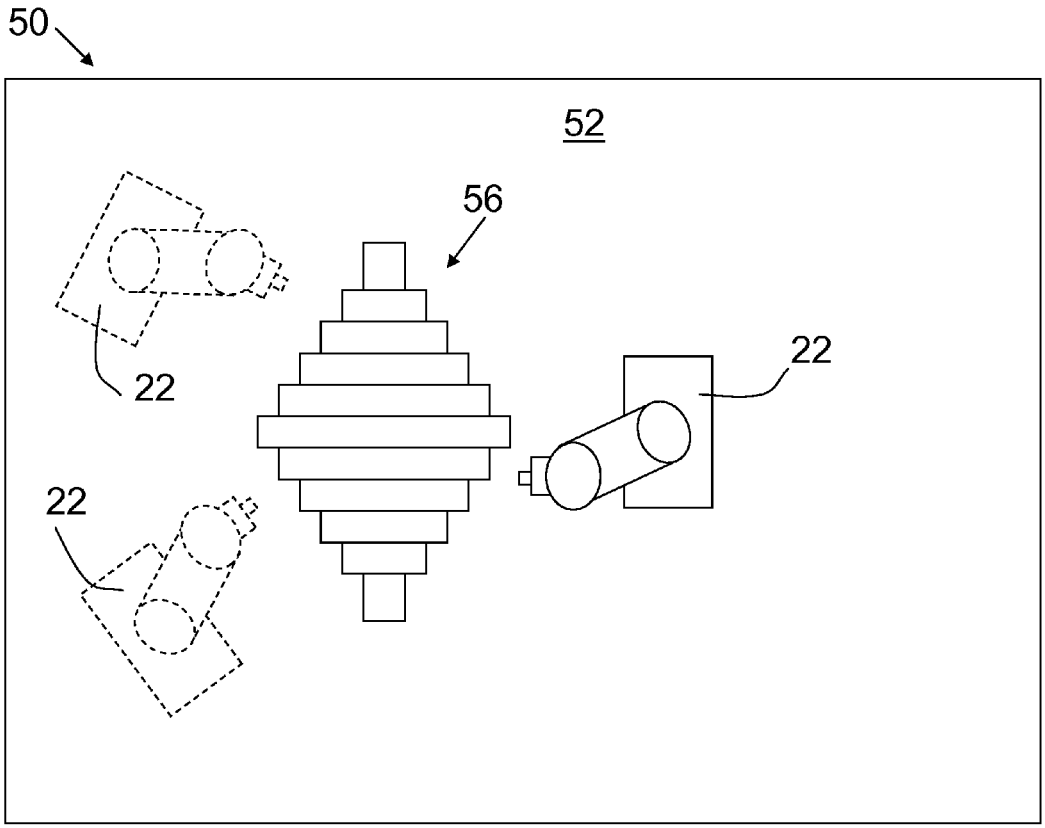
FIG. 7 shows a plan view of a machining station according to an embodiment of the invention.

Turning to FIG. 7, a plan view of the manufacturing station 50 of FIG. 6 is shown. In this plan view, portion of turbine 56 (via stand 54) and apparatus 22 are shown supported by supportive surface 52. However, in one embodiment, apparatus 22 and portion of turbine 56 may be supported by distinct supportive surfaces. Further illustrated in FIG. 7 is the ability of apparatus 22 to be freely moved about portion of turbine 56. As shown in phantom, apparatus 22 may be positioned at a plurality of locations about portion of turbine 56 in order to peen fasteners thereon. In one embodiment, apparatus 22 may be moved about portion of turbine 56 by a truck (e.g., a forklift truck) or crane (e.g., an overhead crane), both of which have been omitted for clarity. In another embodiment, apparatus 22 may be moved about portion of turbine 56 via wheels, tracks, rails, etc. (not shown). Wheels, tracks, rails, etc. may be attached to shock absorbing member 42 and/or base member 36 (FIG. 5), or may be part of a mobile platform (not shown) attached to shock absorbing member 42 and/or base member 36. Where a mobile platform is used to transport apparatus 22, mobile platform may be capable of transporting apparatus 22 in a plurality of directions about portion of turbine 56. For example, mobile platform may be capable of transporting apparatus 22 coaxially with portion of turbine 56 (turbine rotor), perpendicular with portion of turbine 56, diagonally toward portion of turbine 56, diagonally away from portion of turbine 56, etc. In one embodiment, a shock absorbing apparatus (e.g., suspension system) may be incorporated into the wheels, tracks or rails (e.g., on the mobile platform), thereby reducing the shock-absorbing requirements of shock absorbing member 42. In one case, shock absorbing member 42 may be removed and base member 36 may be attached directly to the wheels, tracks, rails, etc. which include a shock absorbing apparatus therein. In any case, where apparatus 22 is movable about portion of turbine 56, apparatus 22 is configured to absorb the internal shock caused by peening of fasteners 16 on portion of turbine 56.

While shown and described herein as an apparatus 22 including robotic control system 40, it is understood that aspects of the invention further provide various alternative embodiments. For example, in one embodiment, the invention provides a computer program embodied in at least one computer-readable medium, which when executed, enables a computer system to provide processing instructions to apparatus 22 in order to peen fasteners. To this extent, the computer-readable medium includes program code, such as robotic control system 40 (FIG. 5), which implements some or all of a process described herein. It is understood that the term "computer-readable medium" comprises one or more of any type of tangible medium of expression capable of embodying a copy of the program code (e.g., a physical embodiment). For example, the computer-readable medium can comprise: one or more portable storage articles of manufacture; one or more memory/storage components of a computing device; paper; and/or the like.

In another embodiment, the invention provides a method of providing a copy of program code, such as robotic control system 40 (FIG. 5), which implements some or all of a process described herein. In this case, a computer system can generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of program code that implements some or all of a process described herein, which includes a computer system receiving the set of data signals described herein, and translating the set of data signals into a copy of the computer program embodied in at least one computer-readable medium. In either case, the set of data signals can be transmitted/received using any type of communications link.

In still another embodiment, the invention provides a method of generating a system for providing processing instructions to apparatus 22 in order to peen fasteners. In this case, a computer system, such as computer system 120 (FIG. 5), can be obtained (e.g., created, maintained, made available, etc.) and one or more modules for performing a process described herein can be obtained (e.g., created, purchased, used, modified, etc.) and deployed to the computer system. To this extent, the deployment can comprise one or more of: (1) installing program code on a computing device from a computer-readable medium; (2) adding one or more computing and/or I/O devices to the computer system; and (3) incorporating and/or modifying the computer system to enable it to perform a process described herein.

It is understood that aspects of the invention can be implemented as part of a business method that performs a process described herein on a subscription, advertising, and/or fee basis. That is, a service provider could offer to provide processing instructions for mapping slag zones in a boiler as described herein. In this case, the service provider can manage (e.g., create, maintain, support, etc.) a computer system, such as computer system 120 (FIG. 5), that performs a process described herein for one or more customers. In return, the service provider can receive payment from the customer(s) under a subscription and/or fee agreement, receive payment from the sale of advertising to one or more third parties, and/or the like.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for peening a fastener on a machine element, the apparatus comprising:
- a peening machine having a hammering head;
- a robotic apparatus including:
  - a robotic arm coupled to the peening machine; and
  - a base member coupled to the robotic arm, the base member mounted independently of the machine element;
- a vision system for locating the fastener on the machine element; and
- a control system coupled to the vision system, the peening machine and the robotic apparatus, the control system configured to control movement of the robotic apparatus and the peening machine based upon vision system data and spatial information about the fastener and the machine element.

2. The apparatus of claim 1, further comprising a shock absorbing member operably attached to the base member.

3. The apparatus of claim 1, further comprising a mobile platform engaging the base member, the mobile platform capable of transporting the base member in a plurality of directions including: coaxially with a turbine rotor, perpendicular with the turbine rotor, diagonally toward the turbine rotor, and diagonally away from the turbine rotor.

4. The apparatus of claim 1, wherein the machine element is a turbine cover plate coupled to at least one turbine blade by the fastener.

5. The apparatus of claim 4, wherein the at least one turbine blade is one of a plurality of turbine blades forming a portion of a turbine assembly, and wherein the base member is mounted independently of the turbine assembly.

6. The apparatus of claim 4, wherein the robotic apparatus and the peening machine are configured to peen the fastener without contacting a portion of the turbine cover plate.

7. The apparatus of claim 1, wherein the peening machine is programmed to actuate the hammering head in a pre-defined pattern in response to a command from the control system.

8. The apparatus of claim 1, wherein the peening machine includes a pneumatic hammering device.

9. The apparatus of claim 1, wherein the vision system data includes data about a location of a reference point of the fastener.

10. A machining station comprising:
- a surface;
- a portion of a turbine rotor in contact with the surface, the portion of the turbine rotor including a machine element having at least one fastener thereon; and
- an apparatus for peening the at least one fastener, the apparatus comprising:
  - a peening machine having a hammering head; and
  - a robotic apparatus including:
    - a robotic arm coupled to the peening machine;
    - a base member coupled to the robotic arm, the base member in contact with the surface independently of the portion of the turbine rotor;
    - a vision system for locating the at least one fastener on the machine element; and
    - a control system coupled to the vision system, the peening machine and the robotic apparatus, the control system configured to control movement of the robotic apparatus and the peening machine based upon vision system data and spatial information about the at least one fastener and the machine element.

11. The machining station of claim 10, wherein the peening machine includes a pneumatic hammering device.

12. The machining station of claim 10, further comprising a mobile platform engaging the base member, the mobile platform capable of transporting the base member in a plurality of directions including: coaxially with the portion of the turbine rotor, perpendicular with the portion of the turbine rotor, diagonally toward an axis of the portion of the turbine rotor, and diagonally away from an axis of the portion of the turbine rotor.

13. The machining station of claim 10, further comprising a shock absorbing member between the base member and the surface, the shock absorbing member in contact with the surface independently of the portion of a turbine rotor.

14. The machining station of claim 10, wherein the peening machine is programmed to actuate the hammering head in a pre-defined pattern in response to a command from the control system.

15. The machining station of claim 14, wherein the predefined pattern is a new fastener pattern that includes actuating the hammering head along an edge of the at least one fastener at least two times.

16. The machining station of claim 10, wherein the robotic apparatus and the peening machine are configured to peen the at least one fastener while only contacting the at least one fastener.

17. A machining station comprising:

a supportive surface;

a stand in contact with the supportive surface;

a portion of a turbine rotor in contact with the stand, the portion of the turbine rotor including a machine element having at least one fastener thereon; and an apparatus for peening the at least one fastener, the apparatus comprising:

a pneumatic peening machine having a hammering head;

a robotic apparatus including:

a robotic arm coupled to the peening machine; and a base member coupled to the robotic arm, the base member in contact with the supportive surface independently of the stand;

a vision system for locating the at least one fastener on the machine element; and a control system coupled to the vision system, the peening machine and the robotic apparatus, the control system configured to control movement of the robotic apparatus and the peening machine based upon vision system data and spatial information about the at least one fastener and the machine element.

18. The machining station of claim 17, wherein the peening machine includes a pneumatic hammering device.

19. The machining station of claim 18, wherein the supportive surface is a floor, and further comprising a shock absorbing member between the base member and the floor, the shock absorbing member in contact with the floor independently of the stand.

20. The machining station of claim 19, wherein the apparatus for peening the at least one fastener is configured to peen the at least one fastener while only contacting the at least one fastener.

* * * * *